US010472922B2

(12) United States Patent
Cuffe

(10) Patent No.: US 10,472,922 B2
(45) Date of Patent: Nov. 12, 2019

(54) WELL PLUG ANCHOR TOOL

(71) Applicant: Isolation Technologies LLC, Houston, TX (US)

(72) Inventor: Chris Cuffe, The Woodlands, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 317 days.

(21) Appl. No.: 15/272,106

(22) Filed: Sep. 21, 2016

(65) Prior Publication Data

US 2017/0081941 A1 Mar. 23, 2017

Related U.S. Application Data

(60) Provisional application No. 62/221,325, filed on Sep. 21, 2015.

(51) Int. Cl.
*E21B 23/01* (2006.01)
*E21B 33/1295* (2006.01)

(52) U.S. Cl.
CPC ..... *E21B 33/12955* (2013.01); *E21B 23/01* (2013.01)

(58) Field of Classification Search
CPC ..... E21B 23/01; E21B 33/1292; E21B 23/06; E21B 33/1293
See application file for complete search history.

(56) References Cited

U.S. PATENT DOCUMENTS 4,368,911 A * 1/1983 Pringle ..... E21B 23/01 166/98
4,791,988 A 12/1988 Trevillion
4,844,154 A * 7/1989 Ross ..... E21B 33/1292 166/139

(Continued)

FOREIGN PATENT DOCUMENTS

WO 2009116875 A1 9/2009

OTHER PUBLICATIONS

Dal Kyong Lee (Authorized Officer), International Search Report and Written Opinion dated Jan. 5, 2017, International Application No. PCT/US2016/052931, filed Sep. 21, 2016, pp. 1-17.

*Primary Examiner* — Kipp C Wallace
(74) *Attorney, Agent, or Firm* — MH2 Technology Law Group LLP

(57) ABSTRACT

A plug assembly, an anchor tool for a plug, and methods for deploying a plug in a wellbore, of which the anchor tool includes a body, engaging members coupled with the body and configured to expand outward from the body, and a sliding sleeve positioned at least partially around the body. When the sliding sleeve is in a first position, the sliding sleeve covers the engaging members and restrains the engaging members from expanding, and when the sliding sleeve is in a second position, the sliding sleeve uncovers the engaging members and permits the engaging members to expand. The anchor tool also includes a friction-inducing member positioned around the body, and a shearable member coupled with the friction-inducing member and the body. The shearable member restrains the friction-inducing member, causing the friction-inducing member to maintain the sliding sleeve in the first position, until the shearable member is sheared.

14 Claims, 4 Drawing Sheets

(56) References Cited

U.S. PATENT DOCUMENTS

| | | | | |
|---|---|---|---|---|
| 9,890,603 | B2 * | 2/2018 | Moore | E21B 40/00 |
| 2002/0117309 | A1 * | 8/2002 | Guillory | E21B 21/103 166/387 |
| 2009/0151960 | A1 | 6/2009 | Rogers et al. | |
| 2010/0314135 | A1 | 12/2010 | Carisella et al. | |
| 2014/0196913 | A1 | 7/2014 | Pedersen et al. | |
| 2015/0152710 | A1 * | 6/2015 | Andersen | E21B 33/124 166/308.1 |

* cited by examiner

WELL PLUG ANCHOR TOOL

CROSS-REFERENCE TO RELATED APPLICATIONS

This application claims priority to U.S. Provisional Patent Application having Ser. No. 62/221,325, which was filed on Sep. 21, 2015 and is incorporated herein by reference in its entirety.

BACKGROUND

Wells may be plugged and abandoned for a variety of reasons, but generally because the formation from which hydrocarbon was being produced is no longer economical or productive. There are several ways to plug and abandon a well; however, regulations typically require a cement plug to be set in the wellbore to permanently isolate an upper portion of the wellbore from a lower portion thereof.

The cement used for these plugs may have a tendency to form cracks or other pathways that allow fluid traversal past the plug. Accordingly, inflatable sealing elements may be used along with the cement. To use such inflatable sealing elements, a section of the casing may be milled out or otherwise removed. Next, a tool including a sealing element is run within the casing, until positioned where the section of casing has been removed. The plug is then inflated, and cement is pumped down onto the top of the inflatable sealing element, such that the sealing element and the cement combine to isolate the lower portion of the well.

However, the cement being pumped down applies a force on the plug, which may sometimes move the plug away from its desired position, e.g., further into the well. In some cases, this inability to remain in place may affect the plugging of the well.

SUMMARY

Embodiments of the disclosure may provide an anchor tool for a plug. The anchor tool includes a body, engaging members coupled with the body and configured to expand outward from the body, and a sliding sleeve positioned at least partially around the body. When the sliding sleeve is in a first position, the sliding sleeve at least partially covers the engaging members and restrains the engaging members from expanding, and when the sliding sleeve is in a second position, the sliding sleeve uncovers the engaging members and permits the engaging members to expand. The anchor tool may also include a friction-inducing member positioned at least partially around the body, and a shearable member coupled with the friction-inducing member and the body. The shearable member restrains the friction-inducing member, causing the friction-inducing member to maintain the sliding sleeve in the first position, at least until the shearable member is sheared.

Embodiments of the disclosure may also provide a plug assembly. The plug assembly includes a plug having an expandable sealing element, and an anchor tool coupled to the plug. The anchor tool includes a body, engaging members coupled with the body and configured to move in a radial direction outward with respect to the body, and a sliding sleeve positioned at least partially around the body, wherein, in a first position, the sliding sleeve at least partially covers the engaging members and restrains the engaging members radially inward, and in a second position, the sliding sleeve uncovers the engaging members. The assembly also includes a friction-inducing member positioned at least partially around the body, and a shearable member coupled with the friction-inducing member and the body. The shearable member restrains the friction-inducing member, causing the friction-inducing member to maintain the sliding sleeve in the first position, at least until the shearable member is sheared Embodiments of the disclosure may further provide a method for deploying a plug in a well. The method includes positioning a plug assembly including the plug and an anchor tool in an upper casing section. The anchor tool includes a body, a sliding sleeve disposed at least partially around the body, the sliding sleeve being slidable between a first position and a second position, the first and second positions being axially offset along the body, engaging members that are restrained radially against the body of the anchor tool by the sliding sleeve in the first position, and a friction-inducing member configured to transmit an axial force incident thereon to the sliding sleeve. The friction-inducing member includes staves that are sized to engage an inner diameter of the upper casing so as to generate a drag force. The anchor tool also includes a shearable member coupling the friction-inducing member with the body. The drag force shears the shearable member. The method also includes running the plug assembly through the upper casing, such that the anchor tool exits the upper casing section and enters an open section downhole of the upper casing and uphole of a lower casing section. The drag force is relieved when the anchor tool exits the upper casing section. The sliding sleeve moves to the second position in response to the drag force being relieved, and the engaging members expand in response to the sliding sleeve moving to the second position. The method also includes running the anchor tool through the open section until the engaging members land on the lower casing section.

Embodiments of the disclosure may additionally provide a method for deploying a plug assembly in a well having an upper casing, an open section and a lower casing. The method includes running the plug assembly through the upper casing, the plug assembly having a plug and an anchor tool, with the anchor tool including engaging members and slip members. The method also includes running the plug assembly into the open section of the well until the engaging members land on the lower casing, and expanding the slip members into engagement with the lower casing.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1A:
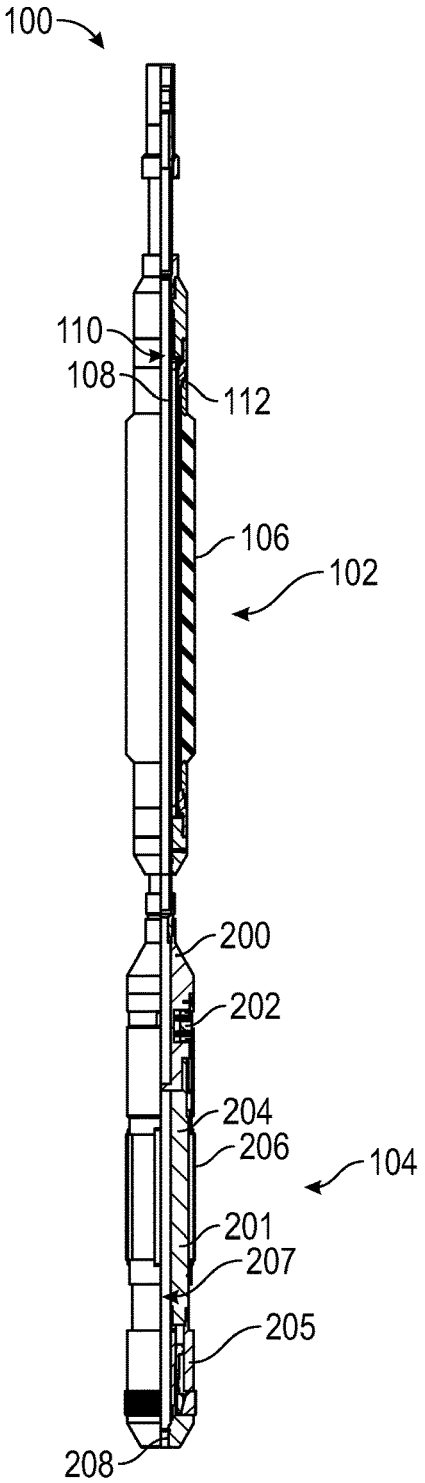
FIG. 1A illustrates a side, half-sectional view of a plug assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1A illustrates a side, half-sectional view of a plug assembly 100, according to an embodiment. In some embodiments, the assembly 100 may be tailored for use in well plugging and abandonment (P&A) operations, but in other embodiments, the assembly 100 may be employed in other contexts. The assembly 100 may generally include a plug 102 and an anchor tool 104.

In an embodiment, the plug 102 may include a sealing element 106, which may be configured to expand in the well, e.g., upon introduction of a pressurized fluid, such as a cement slurry. In some embodiments, the sealing element 106 may be inflatable. However, in other embodiments, the sealing element 106 may be swellable, mechanically-expandable, or otherwise expandable. Further, the plug 102 may include a hollow mandrel 108 about which the sealing element 106 is positioned. The mandrel 108 may define a bore 110 therethrough, which may provide fluid communication axially through the plug 102. The plug 102 may also include a spring-loaded valve 112, which may serve as a one-way poppet valve that allows fluid of at least a predetermined pressure to move from the bore 110 and into the sealing element 106, to radially expand (e.g., inflate) the sealing element 106.

The anchor tool 104 may be positioned "below" the inflatable plug 102, in at least some embodiments. It will be appreciated that directional terms such as "above," "upper," "upward," "below," "lower," "downward," etc. are employed herein to refer to the relative positioning of elements as shown in the figures, but are not to be considered in an absolute sense. For example, the anchor tool 104 is "below" the plug 102, but, if positioned in a horizontal section of a well, may actually be horizontally-aligned with the inflatable plug 102. Thus, the plug 102 may also be thought of as being "uphole" of the anchor tool 104, at least when disposed in a well, and conversely, the anchor tool 104 may be considered "downhole" of the plug 102.

The anchor tool 104 may generally include a body 201, which may include a single unitary piece or two or more different pieces that are attached together. For example, the body 201 may include a cap 200 at an upper end of the body 201, a central sub 204, and a shoe 205 at the lower end of the body 201. In some embodiments, the cap 200 and the shoe 205 may be threaded onto the central sub 204, as shown. In other embodiments, the cap 200 and the shoe 205 may be otherwise connected to the central sub 204, or integral therewith.

Further, the anchor tool 104 may include expandable engaging members ("dogs") 202, which may be disposed in the cap 200. Several dogs 202 may be employed, for example, four. The dogs 202 may be disposed at uniform angular intervals around the body 201, but in other embodiments, may be disposed at irregular intervals or in any other configuration. A friction-inducing member 206 may be disposed at least partially around the central sub 204, e.g., below the cap 200 and/or below the dogs 202. The structure and function of the dogs 202 and the friction-inducing member 206 will be described in greater detail below.

The cap 200, the central sub 204, and the shoe 205 may be hollow, defining a bore 207 that extends through the anchor tool 104. The bore 207 may communicate with the bore 110 of the plug 102, such that fluid communication may be permitted axially through the assembly 100, from the top to the bottom. In addition, the shoe 205 may include a seat 208, which may be configured to catch or otherwise receive a ball, dart, or another type of impeding member, so as to restrict fluid communication through the assembly 100.

Figure 1B:
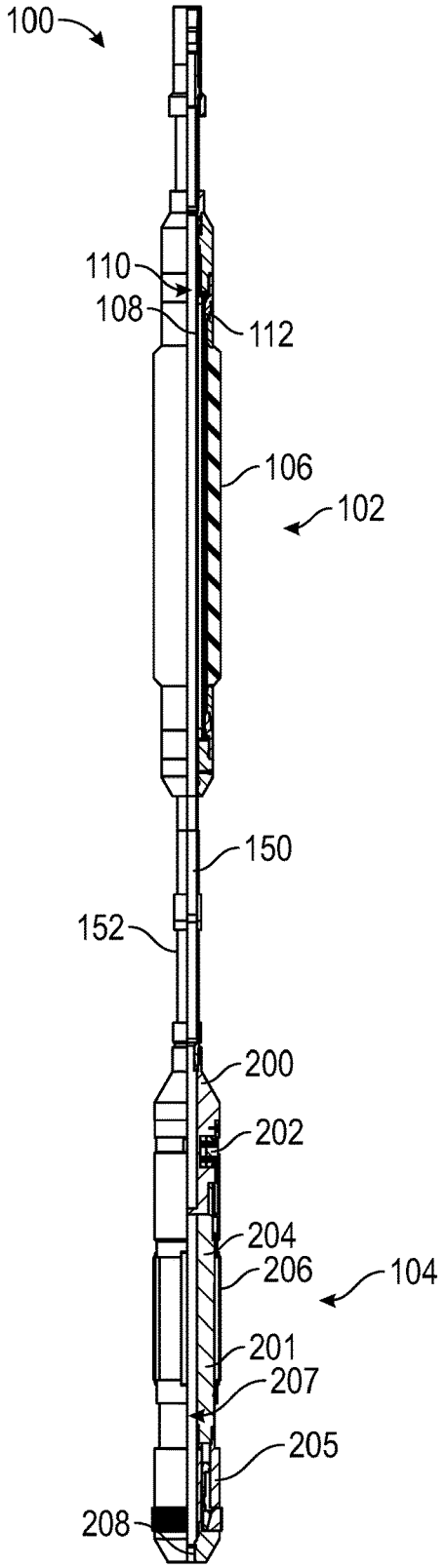
FIG. 1B illustrates a side, half-sectional view of the plug assembly, according to another embodiment.

FIG. 1B illustrates a side, half-sectional view of the assembly 100 according to another embodiment. In this embodiment, a tubular 150 may extend downward from the plug 102, toward the anchor tool 104. A flexible joint (e.g., a "knuckle") 152 may be connected to the tubular 150, and may also be connected to the anchor tool 104. The tubular 150 and the flexible joint 152 may be connected together, end-to-end, such that a bore is defined therebetween, allowing for communication between the plug 102 and the anchor tool 104 therethrough. The flexible joint 152 may accommodate torque and/or bending force between the plug 102 and the anchor tool 104, e.g., so as to allow for a range of rotational and/or lateral pivoting therebetween. This may facilitate running the assembly 100 into the well. Further, the flexible joint 152 may compensate for eccentricities between the larger tubular (e.g., casing) that the plug 102 may be positioned in and the smaller tubular (e.g., casing) that the anchor tool 104 may be positioned in.

Figure 2:
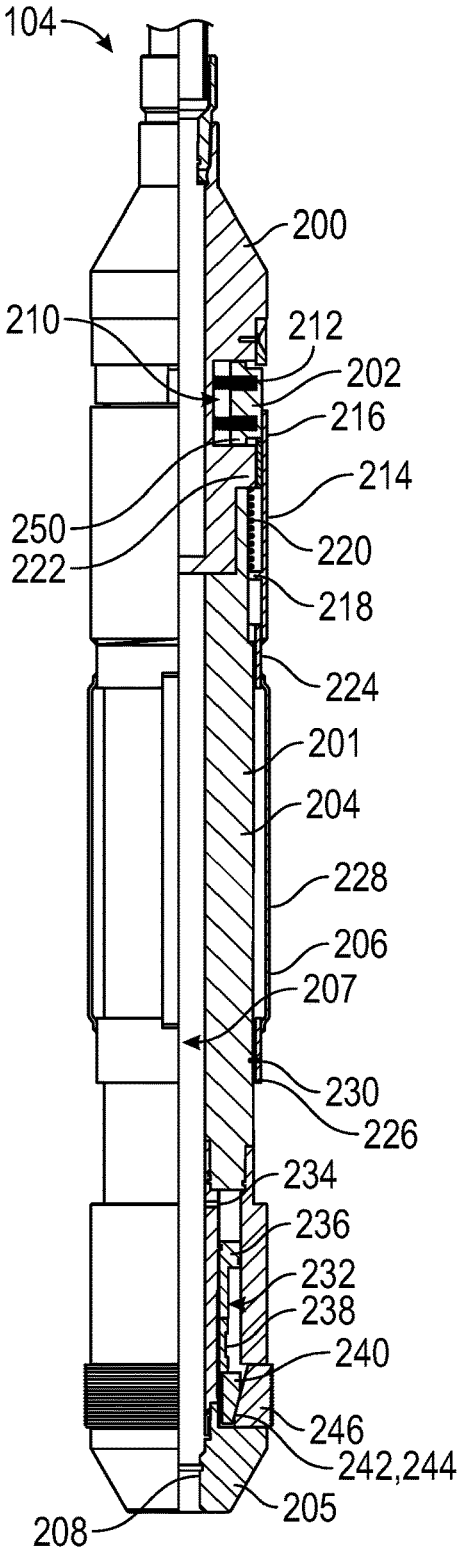
FIG. 2 illustrates a side, half-sectional view of an anchor tool, in a first, retracted configuration, of the inflatable plug assembly, according to an embodiment.

Referring now in greater detail to the anchor tool 104, FIG. 2 illustrates a side, half-sectional view thereof, in a first or retracted configuration, according to an embodiment. As shown, the cap 200 defines a recess 210 in which the illustrated dog 202 is disposed. In some embodiments, several recesses 210 may be provided, e.g., formed as blind holes extending inward into the cap 200, allowing for the individual dogs 202 to be disposed in individual recesses 210. Any number of dogs 202 and recesses 210 may be employed.

Further, one or more first biasing members (two shown: 212) may extend between the radially-inner wall of the recess 210 and the radially-inner side of the dog 202. The first biasing members 212 may be springs, which may be compressed when the anchor tool 104 is in the first configuration, such that the basing members 212 tend to push the dogs 202 radially outwards, away from the body 201.

The anchor tool 104 may also include a sliding sleeve 214, which may, in a first position, be positioned around the cap 200 and, as shown, around the central sub 204. In the illustrated first position of the sleeve 214, an end portion 216 of the sleeve 214, e.g., near the upper end of the sliding sleeve 214, may cover the dogs 202, preventing the biasing members 212 from expanding the dogs 202. The sliding sleeve 214 may further include a first piston 218 extending radially inward, toward the central sub 204. A second biasing member 220 may extend between a shoulder 222, e.g., of the cap 200, and the first piston 218. The second biasing member 220 may be, for example, a spring coiled around the central sub 204, and may be compressed between the first piston 218 and the shoulder 222. Accordingly, the second biasing member 220 may apply a force on the first piston 218 in a direction away from the cap 200, and thus tending to push the sleeve 214 away from the dogs 202.

The friction-inducing member 206, received around the central sub 204, may optionally be coupled to the sliding sleeve 214. For example, the friction-inducing member 206 may include two end collars 224, 226, which may be spaced axially apart, and a plurality of ribs or staves 228 (e.g., bow springs) extending therebetween and connected or integral thereto. The upper end collar 224 may be connected to the sliding sleeve 214, e.g., by welding, fastening, brazing, or in any other manner. In another embodiment, the upper end collar 224 may extend farther axially upward than is illustrated, such that the upper end collar 224 abuts the first piston 218. In such case, the upper end collar 224 may not be fixed to the sleeve 214. The lower end collar 226 may be coupled to the central sub 204 via a shearable member 230, such as a shear pin, shear screw, shear threads, etc.

Proceeding downward in FIG. 2 to the shoe 205, the shoe 205 may define an annulus 232 therein, e.g., around and separated from the bore 207. A pressure port 234 may extend radially at least partially through the shoe 205, so as to fluidly connect the annulus 232 with the bore 207. As such, pressure within the bore 207 may be communicated with the annulus 232 via the pressure port 234. Within the annulus 232, the anchor tool 104 may include a second piston 236. The second piston 236 may, as shown, be positioned below the pressure port 234, such that increased pressure in the bore 207 may tend to push the second piston 236 downward in the annulus 232, e.g., away from the dogs 202.

A ratchet or lock ring 238 may also be positioned in the annulus 232. The lock ring 238 may include teeth on its radially-inner side, which may engage complementary teeth in the shoe 205. The engagement of the teeth may allow the lock ring 238 to move in one direction, e.g., downward, but may prevent movement in a reverse direction. Further, the lock ring 238 may abut the second piston 236, such that movement of the second piston 236 downward causes the lock ring 238 to move accordingly. In some embodiments, the lock ring 238 and the second piston 236 may be attached together, integrally formed, or separate pieces.

The lock ring 238 in turn may engage a cone 240. The cone 240 may have a tapered outer surface 242, which may engage a tapered inner surface 244 of one or more slips 246 that are configured to slide outward with respect to the shoe 205. Accordingly, downward movement of the cone 240 may be translated into outward movement of the slips 246 by engagement between the tapered surfaces 242, 244.

Figure 3:
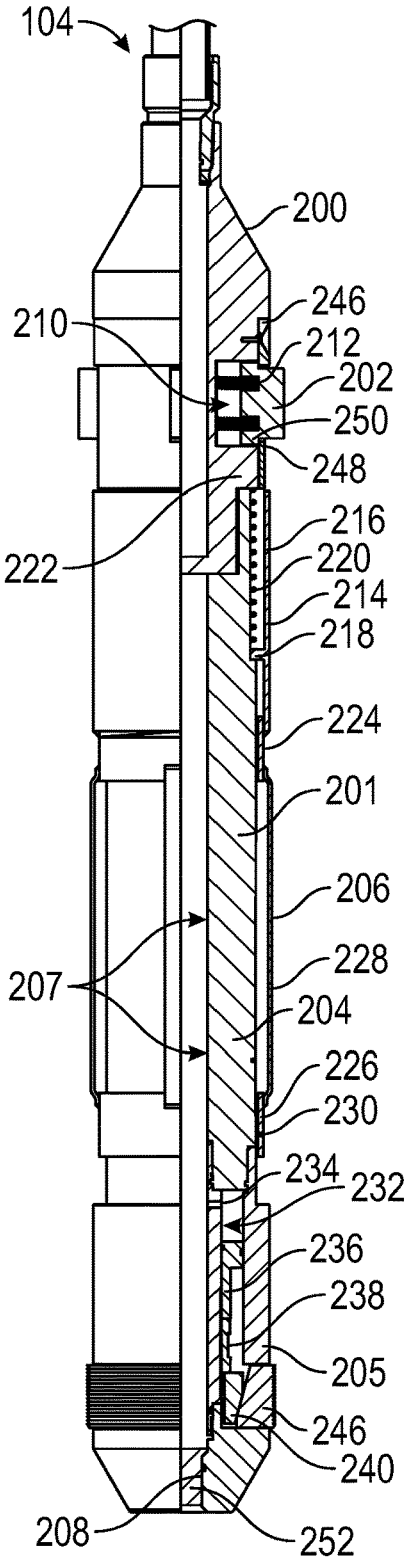
FIG. 3 illustrates a side, half-sectional view of the anchor tool in a second, expanded configuration, according to an embodiment.

Referring now to FIG. 3, the anchor tool 104 is shown moved into a second or expanded configuration, according to an embodiment. In order to move into the expanded configuration, first the shearable member 230 shears or otherwise breaks apart. The shearing of the shearable member 230 will be described in greater detail below. With the shearable member 230 sheared, the friction-inducing member 206, and thus the sliding sleeve 214, are free to move downward.

The second biasing member 220 may provide a force that, if unopposed, pushes the sleeve 214 (via the first piston 218) downward as the second biasing member 220 expands. This moves the end portion 216 of the sleeve 214 away from the dogs 202, and into a second position. In the second position, the end portion 216 of the sleeve 214 may not cover the dogs 202, thus allowing the dogs 202 to expand radially outward under the force of the first biasing members 212. One or more retainers (two shown: 246, 248) may be positioned so as to overhang the recesses 210, and may engage a flange 250 of the dogs 202, so as to prevent the dogs 202 from moving entirely out of their respective recesses 210.

Furthermore, an impeding member (e.g., ball, dart, etc.) 252 may be deployed through the bores 110 (e.g., FIG. 1A) and 207, and may be received by the seat 208 in the shoe 205. The impeding member 252 in the seat 208 may at least partially seal the bore 207, which may allow for an increase in the pressure therein, with respect to pressure exterior to the assembly 100. When the bore 207 is pressured up, the pressure may be communicated via the pressure port 234 into the annulus 232 and to the second piston 236. This may create a pressure differential across the second piston 236, such that the second piston 236 is pushed downwards. In turn, this may push the lock ring 238 and the cone 240 downwards, thereby causing the slips 246 to be driven radially outwards.

Figure 4:
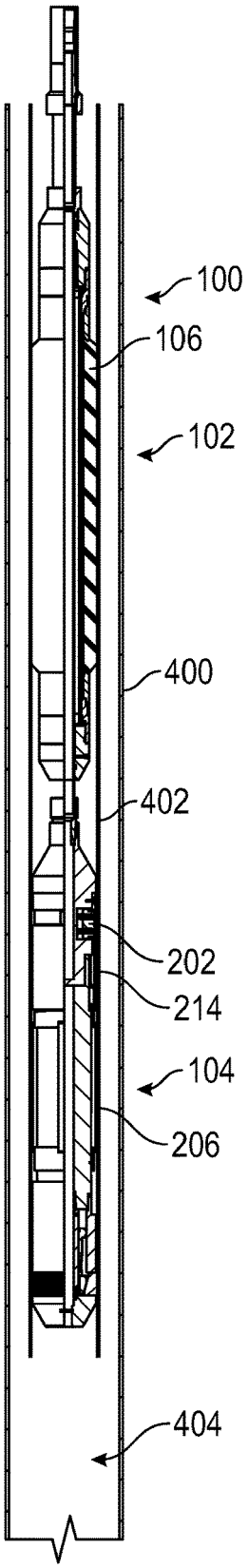
FIGS. 4-6 illustrate three side, half-sectional views of the plug assembly being run into and set in a wellbore, according to an embodiment.
Figure 5:
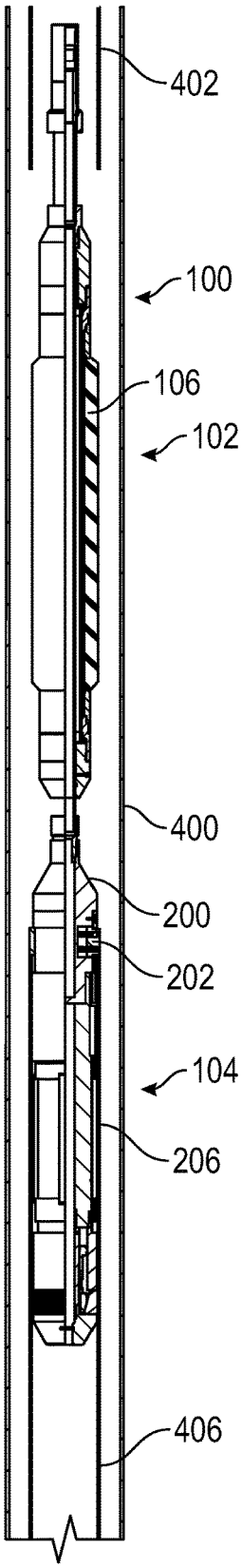
Figure 6:
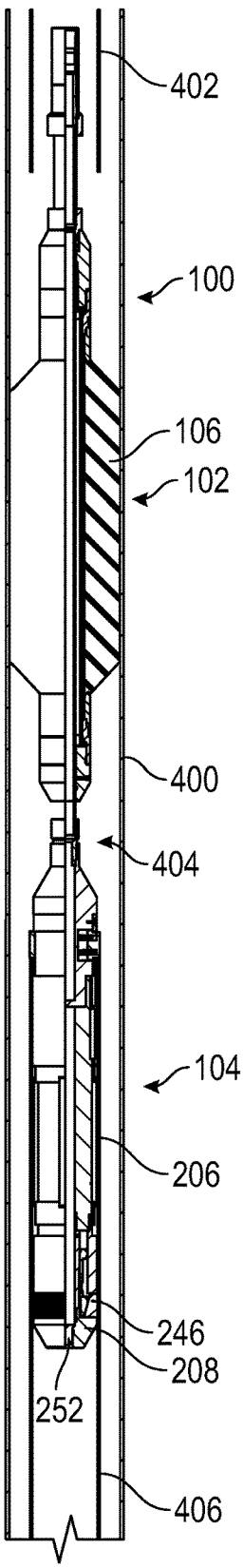

FIGS. 4-6 illustrate an example of deploying the assembly 100 into a wellbore 400, according to an embodiment. Referring specifically to FIG. 4, the wellbore 400 may include an upper casing section 402 and an open section 404. As shown in FIGS. 5 and 6, the wellbore 400 may additionally include a lower casing section 406. The open section 404 may be formed by milling out or otherwise removing the casing at this position.

Referring additionally to FIGS. 2 and 3, the anchor tool 104 may initially have the first configuration (FIG. 2) prior to being deployed into the upper casing section 402. The staves 228 of the friction-inducing member 206 may, however, have an undeflected outer diameter that is equal to or slightly larger than the inner diameter of the upper casing section 402. Accordingly, as the anchor tool 104 is run into the upper casing section 402, the staves 228 may engage the upper casing section 402, generating a drag force on the friction-inducing member 206, and thus on the shearable member 230. The drag force may overcome the shearable member 230, breaking the shearable member 230. Further, the drag force may be higher than the biasing force applied by the second biasing member 220, and thus the drag force on the friction-inducing member 206, which is transmitted to the sleeve 214, may maintain the end portion 216 of the sleeve 214 covering the dogs 202 and preventing their expansion radially outwards, despite the shearing of the shearable member 230.

When the anchor tool 104 exits the upper casing section 402 and enters the open section 404, this drag force may be relieved. As such, the sleeve 214 may be pushed downward by the second biasing member 220 into the second position, thereby uncovering the dogs 202 and allowing the dogs 202 to expand (as shown in FIG. 2). As shown in FIG. 5, the expanded dogs 202 may thus provide an outwardly-extending shoulder in the cap 200 of the anchor tool 104. The outer diameter defined by the dogs 202 may be larger than the inner diameter of the lower casing section 406. Thus, as shown in FIG. 4, the dogs 202 may catch on the lower casing section 406, and may prevent the anchor tool 104 from moving fully therein (e.g., at least the cap 200 above the dogs 202 may protrude upwards) and thus ensuring that the plug 102 is not able to be received into the lower casing section 406.

Further, the impeding member 252 may be dropped into (e.g., pumped down to) the seat 208, as shown in FIG. 6. Accordingly, as explained above, the pressure in the bore 207 may be increased, leading to the slips 246 expanding outwards. The slips 246, being below the dogs 202 and extending into the lower casing section 406, may engage the interior of the lower casing section 406. The slips 246 may thus serve to prevent upward movement of the anchor tool 104, e.g., caused by pressure fluctuations below the anchor tool 104 in the wellbore 400. With the dogs 202 and the slips 246 expanded and engaged with the lower casing section 406, the anchor tool 104 may be prevented from movement in either axial direction, and, as a result, the plug 102 is also prevented from moving in either axial direction.

Continued application of pressure into the bore 207 may then cause the sealing element 106 to expand into engagement with the wellbore 400 in the open section 404. Thereafter, cement may be (e.g., continued to be) pumped into the wellbore 400, such that a cement plug is formed above the sealing element 106.

Figure 7:
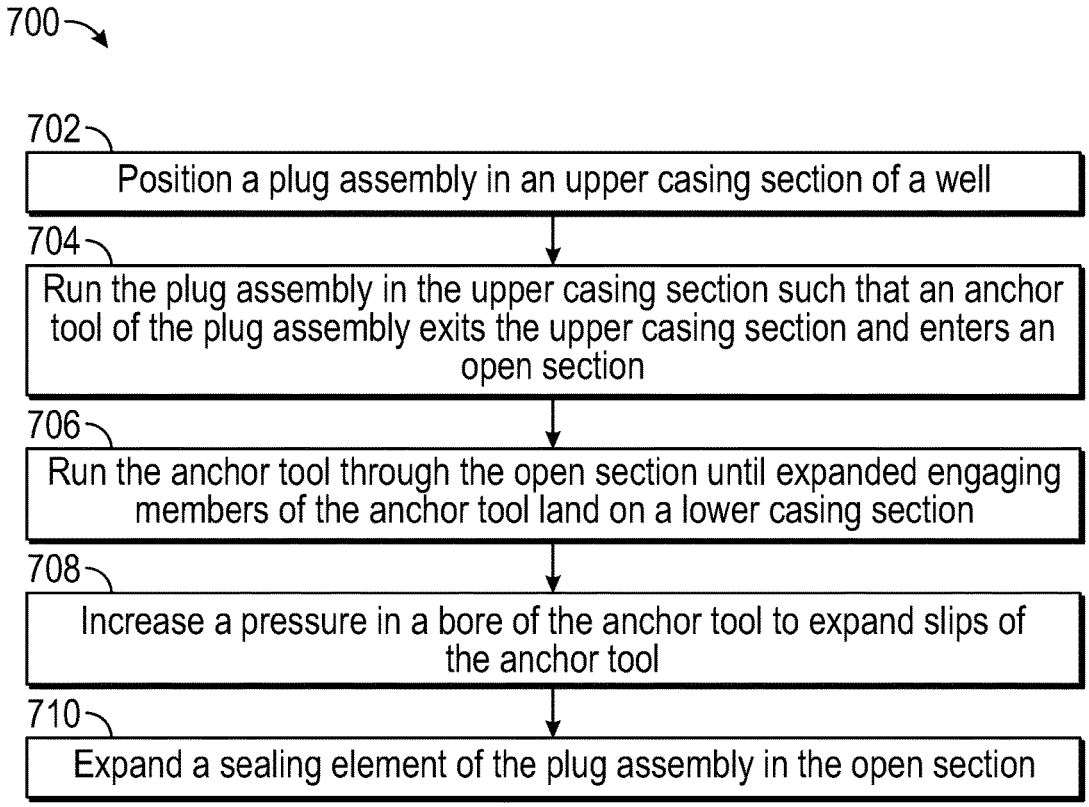
FIG. 7 illustrates a flowchart of a method for plugging a well, according to an embodiment.

FIG. 7 illustrates a flowchart of a method 700 for deploying a plug in a wellbore, according to an embodiment. The method 700 may be executed using the plug assembly 100 as shown in and described above with reference to FIGS. 1-6, and is thus described herein with reference thereto. However, it will be appreciated that the method 700 may be executed using other types of plugs or other tools, and thus embodiments of the method 700 should not be considered limited to the plug assembly 100.

The method 700 may begin by positioning the plug assembly 100 in the upper casing section 402 of a wellbore 400, as at 702. The plug assembly 100 may include the plug 102 and the anchor tool 104, with the anchor tool 104 including the friction-inducing member 206. The friction-inducing member 206 may include the staves 228, which may drag against the upper casing section 402, resulting in a drag force when the plug assembly 100 is moved (run) in the upper casing section 402. Such drag force may shear the shearable member 230, and may serve to prevent the sleeve 214 from moving into the second position and uncovering the dogs 202.

The method 700 may also include running the plug assembly in the upper casing section 402 such that the anchor tool 104 of the plug assembly 100 exits the upper casing section 402 and enters the open section 404, where the casing has been removed, as at 704. This may relieve the drag force on the friction-inducing member 206, as the staves 228 may no longer contact the casing of the upper casing section 402. Accordingly, the sleeve 214 may be moved into the second position, uncovering the dogs 202 and allowing the dogs 202 to expand.

The method 700 may further include running the anchor tool though the open section until the expanded engaging members (dogs) 202 of the anchor tool 104 land on the lower casing section 406, as at 706. The dogs 202 in the expanded configuration, landed on the top of the lower casing section 406, may prevent the anchor tool 104 and the plug 102 from proceeding fully into the lower casing section 406, thus preventing downward movement of the plug 102.

The method 700 may then include increasing a pressure in the bore 207 of the anchor tool 104 to expand the slips 246 of the anchor tool 104, as at 708. The slips 246 may be positioned within the lower casing section 406, and thus, by expanding, may engage therewith. This may serve to prevent, or at least resists, upward displacement of the anchor tool 104 and the plug 102, e.g., under forces applied from below the anchor tool 104 in the wellbore 400.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An anchor tool for a plug, comprising:

a body;

engaging members coupled with the body and configured to expand outward from the body;

a sliding sleeve positioned at least partially around the body, wherein, when the sliding sleeve is in a first position, the sliding sleeve at least partially covers the engaging members and restrains the engaging members from expanding, and when the sliding sleeve is in a second position, the sliding sleeve uncovers the engaging members and permits the engaging members to expand;

a friction-inducing member positioned at least partially around the body;

a shearable member coupled with the friction-inducing member and the body, wherein the shearable member restrains the friction-inducing member, causing the friction-inducing member to maintain the sliding sleeve in the first position, until the shearable member is sheared; and a biasing member engaging the body and the sliding sleeve, wherein the sliding sleeve is biased toward the second position by the biasing member.

2. The tool of claim 1, further comprising other biasing members positioned between the engaging members and the body, wherein the engaging members are biased radially outwards by the other biasing members.

3. The tool of claim 1, wherein the friction-inducing member comprises:

a first end collar that is coupled to the sliding sleeve;

a second end collar that is coupled to the shearable member; and a plurality of ribs extending between the first and second end collars.

4. The tool of claim 1, wherein the engaging members are retained in at least one recess formed in the body, such that, when expanded, the engaging members prevent the anchor tool from moving into a casing having an inner diameter that is smaller than an expanded outer diameter of the engaging members.

5. The tool of claim 1, wherein the friction-inducing member comprises a plurality of staves that are configured to engage a casing and generate a drag force, wherein the drag force shears the shearable member and causes the friction-inducing member to restrain the sliding sleeve in the first position.

6. An anchor tool for a plug, comprising:

a body defining a bore therethrough, an annulus around the bore, and a pressure port extending radially in the body, between the bore and the annulus;

slips that are radially expandable;

a piston disposed in the annulus, wherein a pressure in the bore forces the piston toward the slips, causing the slips to expand;

engaging members coupled with the body and configured to expand outward from the body;

a sliding sleeve positioned at least partially around the body, wherein, when the sliding sleeve is in a first position, the sliding sleeve at least partially covers the engaging members and restrains the engaging members from expanding, and when the sliding sleeve is in a second position, the sliding sleeve uncovers the engaging members and permits the engaging members to expand;

a friction-inducing member positioned at least partially around the body; and a shearable member coupled with the friction-inducing member and the body, wherein the shearable member restrains the friction-inducing member, causing the friction-inducing member to maintain the sliding sleeve in the first position, until the shearable member is sheared.

7. The tool of claim 6, further comprising:

a lock ring abutting the piston; and a wedge abutting the lock ring and having a tapered outer surface, at least one of the slips having a tapered inner surface that slides against the tapered outer surface of the wedge, such that axial movement of the wedge drives the at least one of the slips radially outwards.

8. A plug assembly, comprising:

a plug having an expandable sealing element; and an anchor tool coupled to the plug, the anchor tool comprising:

a body;

engaging members coupled with the body and configured to move in a radial direction outward with respect to the body;

a sliding sleeve positioned at least partially around the body, wherein, in a first position, the sliding sleeve at least partially covers the engaging members and restrains the engaging members radially inward, and in a second position, the sliding sleeve uncovers the engaging members;

a friction-inducing member positioned at least partially around the body; and a shearable member coupled with the friction-inducing member and the body, wherein the shearable member restrains the friction-inducing member, causing the friction-inducing member to maintain the sliding sleeve in the first position, until the shearable member is sheared, wherein the anchor tool is coupled to a lower end of the plug, and wherein a bore of the anchor tool is in communication with a bore of the plug, such that fluid communication is permitted axially through the assembly, wherein the anchor tool is configured to be disposed partially in a lower casing section when the sliding sleeve is in the second position and the engaging members are expanded, thereby preventing the plug from moving into the lower casing section, and wherein the anchor tool comprises slips that are configured to expand into engagement with the lower casing section, to prevent the anchor tool from moving uphole in a well.

9. The assembly of claim 8, further comprising a flexible joint between the plug and the anchor tool.

10. A method for deploying a plug in a well, comprising:

positioning a plug assembly comprising the plug and an anchor tool in an upper casing section, wherein the anchor tool comprises:

a body;

engaging members coupled with the body and configured to expand outward from the body;

a sliding sleeve positioned at least partially around the body, wherein, when the sliding sleeve is in a first position, the sliding sleeve at least partially covers the engaging members and restrains the engaging members from expanding, and when the sliding sleeve is in a second position, the sliding sleeve uncovers the engaging members and permits the engaging members to expand;

a friction-inducing member positioned at least partially around the body;

a shearable member coupled with the friction-inducing member and the body, wherein the shearable member restrains the friction-inducing member, causing the friction-inducing member to maintain the sliding sleeve in the first position, until the shearable member is sheared; and a biasing member engaging the body and the sliding sleeve, wherein the sliding sleeve is biased toward the second position by the biasing member running the plug assembly through the upper casing section, such that the anchor tool exits the upper casing section and enters an open section downhole of the upper casing and uphole of a lower casing section, wherein a drag force generated by the friction-inducing member engaging the upper casing section is relieved when the anchor tool exits the upper casing section, the sliding sleeve moves to the second position in response to the drag force being relieved, and the engaging members expand in response to the sliding sleeve moving to the second position; and running the anchor tool through the open section until the engaging members land on the lower casing section.

11. The method of claim 10, further comprising:

deploying an impeding member into a seat of the anchor tool; and increasing a pressure in a bore of the anchor tool, wherein increasing the pressure causes slips of the anchor tool to expand into engagement with the lower casing section, to prevent uphole movement of the anchor tool.

12. The method of claim 10, further comprising expanding a sealing element of the plug to seal the well.

13. The method of claim 10, wherein relieving the drag force allows the biasing member to expand against the sliding sleeve, forcing the sliding sleeve away from the engaging members.

14. The method of claim 13, wherein the drag force applied to the friction-inducing member forces the sliding sleeve to compress the biasing member.

* * * * *